US008281502B2

(12) United States Patent
Haimerl

(10) Patent No.: US 8,281,502 B2
(45) **Date of Patent: *Oct. 9, 2012**

(54) WATERTIGHT FOOTWEAR COMPRISING AN ELASTIC CONNECTING STRIP

(76) Inventor: Franz Haimerl, Starnberg (DE)

( * ) Notice: Subject to any disclaimer, the term of this patent is extended or adjusted under 35 U.S.C. 154(b) by 1342 days.

This patent is subject to a terminal disclaimer.

(21) Appl. No.: 10/540,963

(22) PCT Filed: Dec. 29, 2003

(86) PCT No.: PCT/EP03/14945

§ 371 (c)(1),
(2), (4) Date: Jul. 10, 2006

(87) PCT Pub. No.: WO2004/060094

PCT Pub. Date: Jul. 22, 2004

(65) Prior Publication Data

US 2006/0248751 A1 Nov. 9, 2006

(30) Foreign Application Priority Data

Jan. 2, 2003 (DE) ..... 103 00 012

(51) Int. Cl.
*A43B 13/28* (2006.01)
*A43B 13/32* (2006.01)
*A43B 9/12* (2006.01)

(52) U.S. Cl. ..... 36/14; 36/12; 36/19 R; 36/21

(58) Field of Classification Search ..... 36/12, 14, 36/19 R, 19 A, 21, 22 R, 22 A, 98
See application file for complete search history.

(56) References Cited

U.S. PATENT DOCUMENTS 3,953,566 A 4/1976 Gore ..... 264/288
(Continued)

FOREIGN PATENT DOCUMENTS

DE 296 01 600 U1 4/1996
(Continued)

*Primary Examiner* — Jila M Mohandesi
*Assistant Examiner* — Sharon M Prange
(74) *Attorney, Agent, or Firm* — Allan M. Wheatcraft

(57) ABSTRACT

Shoe upper having a lower end of the upper, an outer material with a lower end (19) of the outer material, a waterproof functional layer (16), which has a lower end region of the functional layer with a functional layer zone (20) not covered by outer material, and a connecting band (17), which extends in the direction of the periphery of the upper, has a upper longitudinal side (23) of the connecting band, joined to the end (19) of the outer material, and a lower longitudinal side (25) of the connecting band, at least partially overlaps the functional layer zone (20) and consists of liquefiable sealing material or of material through which liquid sealing material (37; 41) can flow, the connecting band (17) having at points of curvature of the lower end (19) of the outer material an arcuate shape corresponding to the local radius of curvature, with different degrees of curvature of the two longitudinal sides (23, 25) of the connecting band, in such a way that, for an arc sector lying in the respective curvature, with a predetermined unitary sector angle, the arc lengths belonging to this arc sector of the two longitudinal sides (23) of the connecting band differ from each other all the more the greater the curvature in the arc sector respectively being considered.

54 Claims, 8 Drawing Sheets

U.S. PATENT DOCUMENTS

| | | | | | |
|---|---|---|---|---|---|
| 4,187,390 | A | | 2/1980 | Gore | 174/102 R |
| 4,194,041 | A | | 3/1980 | Gore et al. | 428/315 |
| 4,493,870 | A | | 1/1985 | Vrouenraets et al. | 428/245 |
| 4,725,418 | A | | 2/1988 | Friemel et al. | 423/305 |
| 5,285,546 | A | * | 2/1994 | Haimerl | 12/142 E |
| 5,329,807 | A | | 7/1994 | Sugar et al. | 73/40 |
| 5,433,021 | A | | 7/1995 | Mahler | 36/12 |
| 5,689,903 | A | * | 11/1997 | Aumann | 36/77 R |
| 5,711,093 | A | * | 1/1998 | Aumann | 36/77 R |
| 5,943,791 | A | * | 8/1999 | Pavelescu et al. | 36/14 |
| 5,946,724 | A | * | 9/1999 | Erickson | 2/93 |
| 6,604,302 | B2 | * | 8/2003 | Polegato Moretti | 36/55 |
| 6,820,352 | B2 | * | 11/2004 | Keidel et al. | 36/12 |
| 7,127,833 | B2 | * | 10/2006 | Haimerl | 36/14 |
| 2002/0040537 | A1 | * | 4/2002 | Polegato Moretti | 36/14 |
| 2002/0053148 | A1 | | 5/2002 | Haimerl | 36/55 |

FOREIGN PATENT DOCUMENTS

| | | | |
|---|---|---|---|
| DE | 100 03 677 | C1 | 8/2001 |
| EP | 0 298 360 | B1 | 3/1994 |
| WO | WO 03/070041 | A | 8/2003 |

* cited by examiner 41
13
39
IV
IV
33
37
35
25
29
17
31
19
11
43

39
33
35
25
37
27
31
24
17
43
15
29
41
23
13

VIII
VIII
11
13
15
17
19
21
23
24
25
27
29
31
32
37
39
41
43
47
49

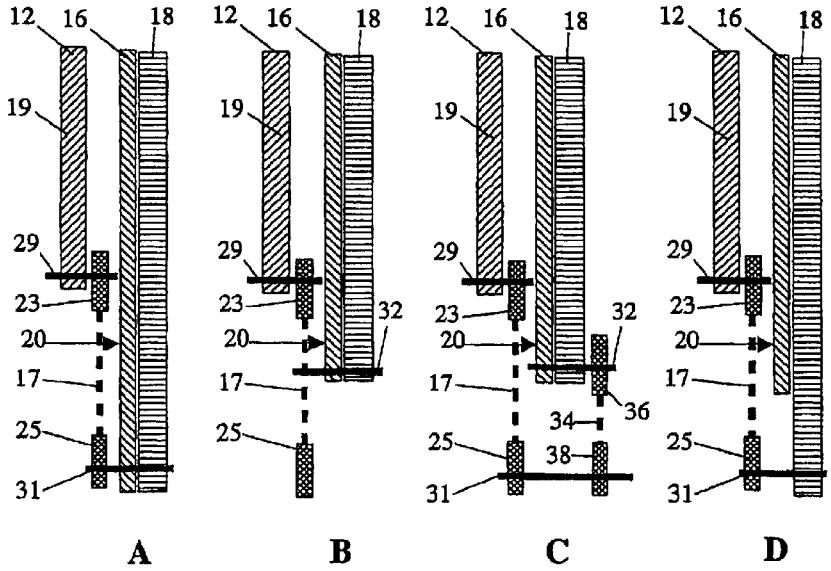
FIG. 14
FIG 15
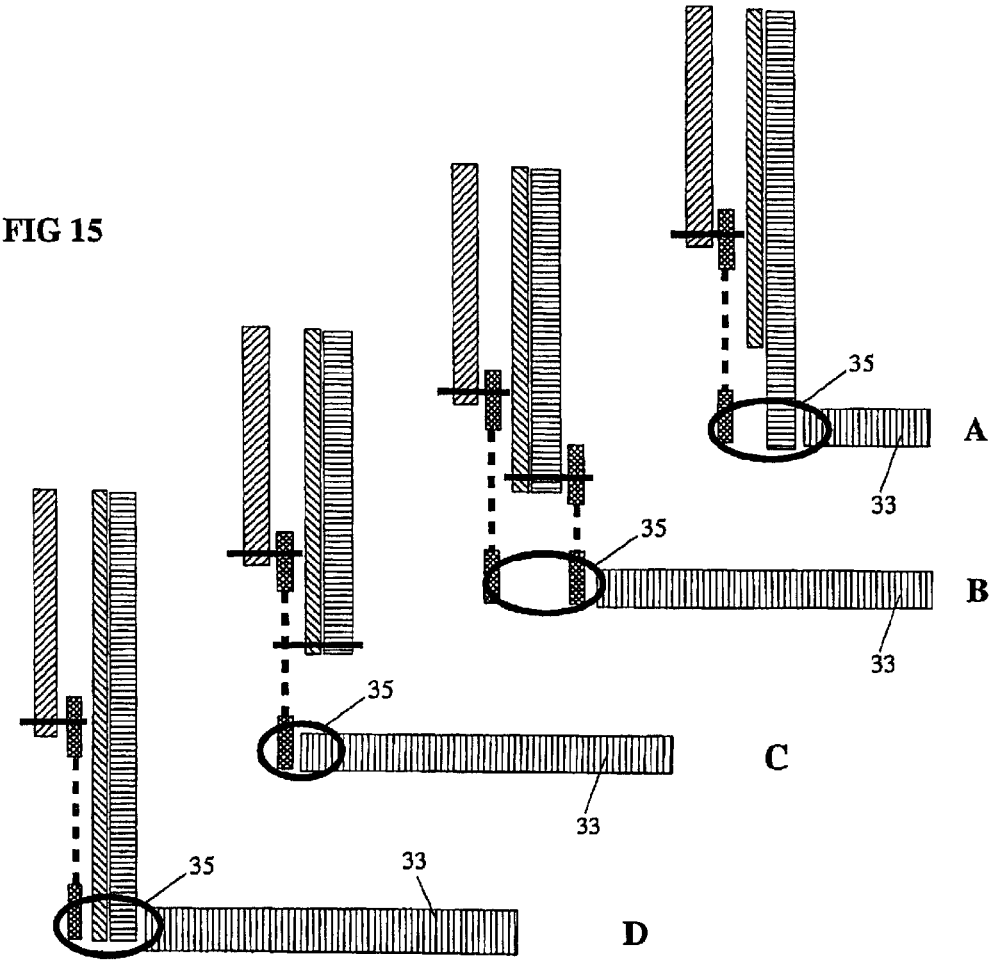

WATERTIGHT FOOTWEAR COMPRISING AN ELASTIC CONNECTING STRIP

FIELD OF THE INVENTION

The invention relates to a shoe upper and to footwear constructed therewith, the upper being provided with a waterproof and preferably also water-vapor-permeable functional layer to produce waterproofness, and the sole region of the footwear being additionally sealed, and also to a process for producing such an upper and such footwear.

BACKGROUND OF THE INVENTION

An example of footwear of this type is shown by the applicant's EP 0 298 360 B1, an outer material of the upper being lined with a lining material of the upper having a waterproof functional layer. The outer material of the upper is cut shorter on the end on the sole side than the lining material of the upper, so that an overhang of the lining material of the upper beyond the outer material of the upper is obtained. The overhang is bridged by a net band, the one longitudinal side of which is sewn to the end on the sole side of the outer material of the upper, but not to the lining material of the upper, and the other longitudinal side of which is sewn to the end on the sole side of the lining material of the upper but not to the outer material of the upper. The net band, preferably comprising monofilament fibers, interrupts a water bridge for water passing from the outer material of the upper that has become wet to the sole region. If the edge on the sole side of the outer material of the upper were to reach down to the edge on the sole side of the lining material of the upper, water creeping down the upper could reach the edge on the sole side of the functional layer and from there get into the inside of the lining, which could lead to the space inside the shoe becoming wet. This footwear is provided with a molded-on outsole, which has at the lower end of the upper such a molded-on height that it embeds the net band and the seam joining it to the outer material of the upper. The net band has such gauze pores that the outsole material, which is liquid when it is being molded on, can penetrate through the net band and force its way to the overhang of the lining material of the upper and thereby seal the part of the functional layer that is located in the region of the overhang. To maintain the breathability of this footwear, its functional layer is not only waterproof but also water-vapor-permeable.

This known construction has proven to be very successful for the production of footwear which is not only breathable but also extremely and reliably waterproof.

One of the problems with this solution is that the upper has a tendency to become folded and distorted in the region of the net band, in particular at those points at which the sole contour of the footwear has a narrow radius of curvature, such as in particular in the region of the toes and heel, which applies most particularly to children's shoes. If the net band extends with its transverse dimension approximately perpendicularly in relation to the outsole, folding occurs, because at most points of the periphery of the end region of the upper the lower end region of the upper does not rise up perpendicularly from the outsole but with an inclination, which applies in particular to the region of the toes of shoes with a soft outer material. If the net band is located in a region of the lower end region of the upper that is turned back parallel to the outsole, folding occurs on account of different degrees of curvature of the edges of the end region of the outer material and the end region of the lining material.

SUMMARY OF THE INVENTION

The invention is based on the object of remedying this and avoiding folding.

A shoe upper according to the invention comprises a lower end of the upper, an outer material with a lower end of the outer material, a waterproof functional layer, which has a lower end region of the functional layer with a functional layer zone not covered by outer material, a connecting band, which extends in the direction of the periphery of the upper, and which has a connecting band upper longitudinal side, joined to the end of the outer material, and a lower longitudinal side of the connecting band, and which at least partially overlaps the functional layer zone and which consists of liquefiable sealing material or of material through which liquid sealing material can flow. At points of curvature of the lower end of the upper the connecting band extends in an arc corresponding to the local radius of curvature, with the two longitudinal sides of the connecting band having different degrees of curvature, in such a way that, for an arc sector lying in the respective curvature, with a predetermined unitary sector angle, the arc lengths belonging to this arc sector of the two longitudinal connecting band sides differ from each other the more the greater the curvature in the arc sector is.

The curvatures of the two longitudinal sides of the connecting band are in this case adapted to the different radii of curvature of the materials joined to the two longitudinal sides of the connecting band.

In one embodiment of the invention, the lower longitudinal side of the connecting band is joined to the functional layer. In another embodiment of the invention, a region of the connecting band located between the two longitudinal sides of the connecting band is joined to the functional layer. In a further embodiment of the invention, the lower longitudinal side of the connecting band is joined to a lining arranged on the inner side of the functional layer. In a further embodiment of the invention, the lower longitudinal side of the connecting band is joined to a lower longitudinal side of a second connecting band, which forms an extension of a lower end of the functional layer and/or of said lining. In a further embodiment of the invention, the lower longitudinal side of the connecting band is joined to an intermediate sole, for example an insole. The lower longitudinal side of the connecting band may also be joined to a number of these elements.

In one embodiment of the invention, at points of the lower end of the upper with convex curvature, the arc length of the upper longitudinal side of the first connecting band is longer than the arc length of the lower longitudinal side of said connecting band.

In one embodiment of the invention, at points of the lower end of the upper with concave curvature, the arc length of the lower longitudinal side of the first connecting band is longer than the arc length of the upper longitudinal side of said connecting band.

The curvatures of the two longitudinal sides of the connecting band are in this case adapted to the different radii of curvature of the materials joined to the two longitudinal sides of the connecting band.

In this connection, convex and concave mean that the peripheral contour of the lower end of the upper corresponding to the peripheral contour of the sole that is later to be attached is pre-curved outward or drawn-in inward, viewed from the middle of the later sole surface.

The terms arc sector, arc lengths and unitary sector angle are explained in more detail at a later point with the aid of FIG. 13.

Footwear according to the invention comprises a shoe upper of this type and a sealing material which seals the functional layer zone in a waterproof manner in a sealing material zone that is located in the region of the connecting band and extends in the peripheral direction of the end of the upper.

In the case of the known footwear of the type mentioned at the beginning, folding of the upper has been caused in the region of the net band because it has not been taken into account that the curved end of the outer material which is joined to the upper longitudinal side of the connecting band and the curved material which is joined to the lower longitudinal side of the connecting band or to a region of the connecting band located between the two longitudinal sides of the connecting band have different arc lengths at points at which the lower periphery of the end region of the upper has a curvature, which applies in particular in the region of the toes and in the region of the heel, the difference in arc length depending on the degree of local curvature. If, in the previously customary way, use is made of a net band which is not adapted, or is not adaptable, to the different curvatures of the periphery of the end region of the upper, fold-like distortions inevitably occur on account of the different curvatures and curvature arc lengths on the two longitudinal sides of the net band, and these distortions can also be transferred to the material that is sewn onto the net band, in particular the functional layer material, and possibly the lining material, which materials are generally softer than the outer material. Such folding of the net band may have the effect that sealing material which is intended to penetrate through the net band as far as the functional layer no longer forces its way through adequately or adequately uniformly to the functional layer at the points of the folds, and the sealing of the functional layer zone adjacent to the net band no longer succeeds in a satisfactory way. Folding in the functional layer material and/or in the lining material and/or in the outer material requires thicker layers of adhesive for the cement-lasting in the case of a lasted upper and/or for the cementing on of an outsole, and consequently a higher sole construction than would be required without folding. This also applies to molded-on outsoles, the upright sole side edge of which must be molded higher in the case of folding.

It has already been attempted to reduce the problem of folding by using a conical net band with which the upper longitudinal side of this net band forms a circle with a smaller diameter than the lower longitudinal side when it is bent together to form a circle. A net band of this type, which is produced by a weaving operation and is relatively rigid, is on the one hand complex to produce and on the other hand can only be adapted to a quite specific curvature of the periphery of the end region of the upper. At points of different curvature, the problem of folding remains, however, and, at points at which the direction of curvature is opposed to that for which the conical net band is designed, the problem of folding is intensified in comparison with a neutral net band of a conventional type. Normally, the conical net band is designed for curvatures in the region of the toes or heel of the shoe. On the inner side of the middle region of the foot, however, the shoe usually has an opposed direction of curvature. There, the conical net band exacerbates the problems instead of reducing them.

This is avoided in the case of footwear with an upper according to the invention by the use of a connecting band which is adapted or adaptable to different curvature along the periphery of the end region of the upper. Connecting band adapted to different curvature is already provided during production with a curvature that is adapted to a specific shoe model, in that it is for example punched out or injection-molded with the suitable shape of curvature. An elastically or plastically extendible strip is suitable as an adaptable connecting band, the adaptation to different curvatures being achievable by choice of a longitudinal tensile pre-stress during the joining to the end region of the outer material and to the material joined to the lower longitudinal side of the connecting band or the material joined to a middle region of the connecting band.

An elastically extendible connecting band is particularly preferred, because it is adaptable to the different curvature conditions particularly simply and without being designed for a specific shoe model.

In order to obtain the desired effect, that is the avoidance of folding, the longitudinal side of the elastic connecting band that is joined to the material other than the outer material must be elastically extendible and joined to this other material while being subjected to longitudinal tensile pre-stress at points of the lower end of the upper with convex curvature, it being possible for the other material to be the functional layer, the lining, the lower longitudinal side of the already mentioned second connecting band and/or an insole or some other intermediate sole. The longitudinal side of the elastic connecting band that is joined to the end of the outer material does not have to be, but may be, elastically extendible and does not have to be, but may be, joined to the end of the outer material while being subjected to longitudinal tensile pre-stress. If both longitudinal sides of the elastic connecting band are joined while being subjected to longitudinal tensile pre-stress, it is recommendable, but not absolutely necessary, to join the lower longitudinal side of the connecting band while being subjected to the same longitudinal tensile pre-stress as the longitudinal side of the connecting band that is joined to the end of the outer material.

The fact that this elastic connecting band is joined to the material that is to be joined to it while being subjected to longitudinal tensile pre-stress on its lower longitudinal side and attempts to contract into its non-extended position means that the lower longitudinal side of the elastic connecting band is shortened in comparison with the upper longitudinal side, thereby preventing folding.

It is advantageous to subject the elastic connecting band to a longitudinal tensile pre-stress also as it is being joined to the end of the outer material. This achieves the effect that the elastic connecting band contracts under curvature on the lower longitudinal side that is joined to the other material particularly intensively and, as a result, folding is prevented most particularly well. After joining the connecting band to the end of the outer material while being subjected to longitudinal tensile pre-stress, it is also easier to fasten the functional layer and/or the lining and/or the other material to the connecting band while being subjected to longitudinal tensile pre-stress, since the outer material contracts with the elastic connecting band fastened to it while being subjected to longitudinal tensile pre-stress, and consequently the joining of the functional layer and/or of the lining material and/or of the other material to the connecting band without renewed exertion of a longitudinal tensile pre-stress may involve difficulties, in particular if the outer material and the other material, for example lining material, cannot extend to the same degree in the peripheral direction of the end of the upper.

At points of the lower end of the upper with concave curvature, a reverse procedure is recommendable, that is to join the upper longitudinal side of the elastic connecting band to the end of the outer material while being subjected to longitudinal tensile stress.

In one embodiment of the invention, at least one of the joins is achieved by means of a sewn seam.

When the upper is being stretched onto a last, the elastic connecting band makes it possible in a very simple way for the connecting band to be pulled under the edge of the last on the sole side. On account of the longitudinal tensile pre-stress, the elastic connecting band flips into a position parallel to the outsole later to be applied, which may facilitate subsequent processing steps. The connecting band remains free of folds, which is important in particular in the case of shoes with a narrow radius of curvature of the peripheral contour of the sole, most particularly in the case of pointed shoes and small shoes, for example children's shoes and smaller ladies' sizes. The fact that there are no longer any folds means that, when the connecting band is formed as a net band, the subsequently applied sealing material can penetrate well through the net band at all points, so that a particularly high-quality and durable waterproofness of the finished footwear is obtained. Since folds no longer occur, thinner soles can be used. This has a particularly positive effect in the case of shoes on which the lower end region of the upper including the connecting band is turned back around the lower edge of the last and remains in this position, and the outsole does not need to have a edge rising up to the upper in order to cover a connecting band, which extends with its transverse dimension approximately perpendicularly in relation to the outsole. This is so because, since the connecting band disappears under the lower edge of the last without any problem and free from folds, it is no longer necessary to make the edge of the sole particularly high on the upper. As a result, when a water-vapor-permeable and consequently breathable functional layer and a molded-on or cemented-on outsole are used, an unnecessarily great amount of this functional layer is also not covered by non-breathable sole plastic and blocked with respect to breathability. The connecting band used according to the invention consequently contributes to the increase in the overall breathability of the footwear.

In one embodiment of the invention, a lining material is located on the inner side of the functional layer that is remote from the outer material, either as a separate layer of material or as a component part of a laminate comprising the functional layer and the lining material. In both cases, the functional layer can extend as far as the lower edge of the lining material or may end at a predetermined distance above the lower edge of the lining material.

In one embodiment of the invention, the lower edge of the functional layer and/or the lower edge of the lining material ends approximately at the height of the lower longitudinal side of the connecting band and is joined to the latter.

In one embodiment of the invention, the lower edge of the functional layer and/or the lower edge of the lining material ends above the height of the lower longitudinal edge of the connecting band and is not joined to the latter at all or is joined to an intermediate region of the connecting band located between the two longitudinal sides of the connecting band. In the embodiment wherein the lower edge of the functional layer and/or the lower edge of the lining material ends above the lower longitudinal side of the connecting band, the lower edge of the functional layer and/or the lower edge of the lining material may be joined by means of a second connecting band to the lower longitudinal side of the first connecting band and/or to an intermediate sole, for example an insole, or in the case of the sole construction without an intermediate sole or an insole, to a lashing string. The second connecting band may be constructed in a way similar to the first connecting band, in particular with regard to a different shape of curvature of the two longitudinal sides of the second connecting band, adapted to the local curvature of the periphery of the lower end of the upper.

In the case of the process according to the invention for producing a shoe upper, which comprises an outer material and a waterproof functional layer arranged on the inner side of the outer material of the upper, providing an outer material piece cut in the shape of the upper and providing a functional-layer piece cut in the shape of the upper in such a way that a lower end region of the functional-layer piece has a functional layer zone that is not covered by the outer material after the functional-layer piece has been arranged in the correct position on the inner side of the outer material piece. The lower edge of the outer material piece is joined across its entire periphery to an upper longitudinal side of a connecting band consisting of liquefiable sealing material or of material through which liquid sealing material can flow. In this case, the connecting band is provided at points of curvature of the lower end of the upper with an arcuate shape corresponding to the local radius of curvature, with different degrees of curvature of the two longitudinal sides of the connecting band, in such a way that, for an arc sector lying in the respective curvature, with a predetermined unitary sector angle, the arc lengths of the two longitudinal sides of the connecting band sides belonging to this arc sector differ from each other all the more the greater the curvature of the arc sector is.

In one embodiment of the invention, the functional layer zone that is not covered by the outer material of the upper is formed by an overhang of the end region of the functional layer with respect to the end region of the outer material.

In one embodiment of the invention, the connecting band is non-porous.

In a first variant of this embodiment, the non-porous connecting band or part thereof serves as sealing material, which is activated by activation, for example by means of thermal energy, high-frequency energy, infrared energy or UV energy, and thereby temporarily brought into a liquid and adhesive state, wherein it develops its sealing effect. For example, the connecting band has an elastic textile strip as a backing, which is coated with a sealing compound.

In a second variant of this embodiment, wherein an intermediate sole or outsole is molded onto the footwear, a material which can be melted by the sole material which is hot-liquid during the molding-on of the sole is used for the connecting band. Since the part of the footwear on the sole side is in this case kept in shape by the molded-on sole, the stability of the footwear is still ensured even if the connecting band is completely melted away during the molding-on of the sole.

A polyurethane strip is suitable for example for the non-porous connecting band.

In another embodiment of the invention, the connecting band is porous or permeable and preferably has the form of a net band, with such porosity or permeability that it can be penetrated by liquid sealing material. The liquid sealing material is either sole material that is liquid during the molding-on of a sole or, in particular if the footwear is provided with a cemented-on outsole, a sealing adhesive that leads to waterproofness in the cured state, preferably in the form of reactive hot-melt adhesive that leads to waterproofness in the fully reacted state. In this case, the sealing adhesive is substantially applied only to the porous connecting band and seals the functional layer in that region of the functional layer zone which is opposite the porous connecting band.

It is important that the connecting band is elastic at least on its lower longitudinal side, while the other longitudinal side of the connecting band may be at least extendible or likewise elastic.

In one embodiment of the invention, the porous or permeable elastic net band has the form of a ladder, two longitudinal webs forming the two longitudinal sides of the net band being joined by transverse webs uniformly spaced apart from one another in the longitudinal direction of the net band. In this case, at least one of the longitudinal webs is elastic, while the transverse webs are preferably rigid or non-elastic. In one embodiment of the net band, the longitudinal webs consist of unvulcanized rubber, vulcanized rubber, latex or an elastomer, for example Elastan, while the transverse webs preferably consist of polyamide, polyester or a similar non-elastic material.

With regard to an elastic net band formed in such a way, there are several variants which are suitable for the purpose according to the invention, for example:

- both longitudinal webs are plastically deformable by 100% in such a way that folding does not occur at the points of curvature of the lower end of the upper;
- both longitudinal webs are elastically deformable by 100% in such a way that folding does not occur at the points of curvature of the lower end of the upper;
- both longitudinal webs are each partially elastically and plastically deformable in such a way that folding does not occur at the points of curvature of the lower end of the upper;
- one of the two longitudinal webs is partially elastically and plastically deformable and the other longitudinal web is plastically deformable by 100% in such a way that folding does not occur at the points of curvature of the lower end of the upper;
- one of the two longitudinal webs is partially elastically and plastically deformable and the other longitudinal web is elastically deformable by 100% in such a way that folding does not occur at the points of curvature of the lower end of the upper.

In an embodiment of the invention using an elastic net band, the net band is produced by a weaving operation, the longitudinal webs being formed by longitudinal or warp threads which are woven with transverse or weft threads. Longitudinal threads are provided only in the region of the longitudinal webs. In the central region between the longitudinal webs, remaining free of longitudinal threads, the transverse threads form the transverse webs. In this case, the transverse webs are arranged at such a spacing from one another that the net band is given adequate permeability for sealing material. To obtain the elasticity, elastic threads forming longitudinal threads are kept under tensile stress during the weaving operation, at least if they belong to one of the two longitudinal webs. The elastic net band can be variously formed, according to specific requirements. There are possibilities for only one of the longitudinal webs to be elastic, for both longitudinal webs to be elastic, for the two longitudinal webs to have different elasticity and also for the net band to have zones of different elasticity along its length, in order for example to provide a greater elasticity in the region of the toes and heel of the footwear and a lesser elasticity in the side foot regions of the footwear.

The possibility of using a net band with constant elasticity over its length for the entire periphery of the shoe upper is preferred, it being possible for the net band to be sewn to the outer material while being subjected to a greater longitudinal tensile pre-stress at the points of smaller radius of curvature, that is in the region of the toes and heel, than in the region of the longitudinal sides of the foot.

The solution according to the invention is suitable both for a footwear construction with an insole and for a footwear construction without an insole.

In the case of a footwear construction without an insole, the end region of the upper on the sole side is lashed together by a lashing string (also known by the term string lasting). In the case of a footwear construction with an insole, the upper material is joined to the insole either by sealing by a Strobel seam, i.e. by means of a Strobel seam joining the upper material and the insole, or by cemented-lasting of a lasting allowance belonging to the lower end region of the upper onto the underside of the insole by means of lasting cement. The use of both fastening methods in combination on one and the same footwear is also possible, with for example the end region of the functional layer being joined to the insole by means of a Strobel seam and the end region of the outer material being joined to the insole by means of cement-lasting. There is also footwear with a part-insole, which only extends over part of the length of the footwear, the lower end of the upper being lashed together by means of a lashing string over the part of the length of the shoe that has no insole and cement-lasted over the part of the length of the shoe that has the part-insole. In a corresponding way, the elastic connecting band is joined to the peripheral edge of the insole by means of the Strobel seam or the longitudinal side of the connecting band that is not joined to the outer material of the upper is fastened to the edge of the lasting allowance.

The use of an elastic connecting band has the effect that, after the joining of one longitudinal side of the connecting band to the outer material of the upper while being subjected to longitudinal tensile pre-stress, the part of the connecting band that is not joined to the outer material of the upper flips inward in such a way that this part of the connecting band extends away approximately perpendicularly from the inner side of the end region of the upper on the sole side and extends approximately parallel to the outsole still to be attached. This is advantageous to the extent that the lateral edge of the molded-on or cemented-on outsole does not need to be as high as in the case where the connecting band remains perpendicular to the outsole and/or has folds.

Suitable in particular for sole constructions which have neither a waterproof insole nor a waterproof intermediate sole nor a waterproof outsole is an embodiment of the invention wherein there is provided a sheet-like waterproof sealing layer which is applied to the underside of a turned-back end region of the upper such that it extends parallel to the still to be applied outsole in such a way that a lower opening of the upper is sealed as far as the sealing material zone. The sealing layer is preferably a sealing sheet (also known to those skilled in the art as a gasket), which is cemented onto the underside of the insole or, if it is an insole-free construction with a lashing string, onto the underside of the turned-back, lashed-together end region of the upper. In one embodiment, the sealing sheet is waterproof and preferably also water-vapor-permeable. It may be constructed with a laminate which has a backing material layer and a waterproof, preferably also water-vapor-permeable functional layer.

Depending on the specific construction of the sole, the sealing layer may also be an intermediate sole or an outsole or else a layer of sealing material, for example in the form of a sealing adhesive applied to the inner side of the outsole or sealing adhesive applied only to the connecting band formed as a net band, in particular in the form of reactive hot-melt adhesive.

For sealing the functional layer by means of the connecting band (if the latter has sealing material itself) or through the sealing strip (if the latter is formed as a porous or permeable net band), any material leading to waterproofness is suitable. In the case of the use of adhesive having sealing properties as the sealing material, preference is given to reactive hot-melt adhesive, which brings about particularly good sealing in the region of the sole construction of the footwear. Reactive hot-melt adhesive has, on the one hand, particularly great creepability in the liquid state before fully reacting and, on the other hand, brings about particularly great and durable waterproofness in the fully reacted state. The reactive hot-melt adhesive can be applied with very simple means, for example be brushed on, sprayed on or applied in the form of a strip of adhesive or a bead of adhesive, the reactive hot-melt adhesive being made tacky by heating and, as a result, allowing itself to be fixed in the region of the connecting band before the full reacting process and accompanying durable adhesive bonding to the functional layer begins.

The adhesive bonding of the reactive hot-melt adhesive or other sealing material to the functional layer is particularly intimate if the reactive hot-melt adhesive or the other sealing material is mechanically pressed against the functional layer after being applied to the connecting band. Preferably suitable for this purpose is a pressing device, for example in the form of a pressing pad, with a smooth material surface which cannot be wetted by the reactive hot-melt adhesive or other sealing material and therefore cannot bond with the reactive hot-melt adhesive or the other sealing material, for example of non-porous polytetrafluoroethylene (also known by the trade name Teflon), silicone or PE (polyethylene). Preferably used for this purpose is a pressing pad, for example in the form of a rubber pad or air cushion, the pressing surface of which is covered with a film of one of the said materials, for example non-porous polytetrafluoroethylene, or such a film is arranged between the sole construction provided with the reactive hot-melt adhesive or the other sealing material and the pressing pad before the pressing operation.

Preferably, a reactive hot-melt adhesive which can be cured by means of moisture is used, which adhesive is applied to the region to be adhesively bonded and exposed to moisture to make it fully react. In one embodiment of the invention, a reactive hot-melt adhesive which can be thermally activated and can be cured by means of moisture is used, which adhesive is thermally activated, applied to the region to be adhesively bonded and exposed to moisture to make it fully react.

Reactive hot-melt adhesives refer to adhesives which, before their activation, comprise relatively short molecular chains with an average molecular weight in the range from approximately 3000 to approximately 5000 g/mol, are non-adhesive and, possibly after thermal activation, are brought into a state of reaction wherein the relatively short molecular chains are crosslinked to form long molecular chains and thereby cure, doing so predominantly in moist atmosphere. During the reaction or curing time, they are capable of adhesive bonding. After the crosslinking curing, they cannot be re-activated. When they fully react, three-dimensional crosslinking of molecular chains can occur. The three-dimensional crosslinking leads to particularly great protection against water ingress into the adhesive.

Suitable for example for the purpose according to the invention are polyurethane reactive hot-melt adhesives, resins, aromatic hydrocarbon resins, aliphatic hydrocarbon resins and condensation resins, for example in the form of epoxy resin.

Particularly preferred are polyurethane reactive hot-melt adhesives, referred to hereafter as PU reactive hot-melt adhesives.

In one practical embodiment of footwear according to the invention, a PU reactive hot-melt adhesive which is obtainable under the name IPATHERM S 14/242 from the company H. P. Fuller of Wells, Austria, is used. In another embodiment of the invention, a PU reactive hot-melt adhesive which is obtainable under the name Macroplast QR 6202 from the company Henkel AG, Dusseldorf, Germany, is used.

A functional layer which is not only water-impermeable but also water-vapor-permeable is particularly preferred. This makes it possible to produce waterproof shoes which remain breathable in spite of being waterproof.

In one embodiment of the invention, the functional layer of the lining material of the upper and/or the sealing sheet has a layer of expanded microporous polytetrafluoroethylene (ePTFE).

A functional layer is regarded as "waterproof", if appropriate including seams provided at the functional layer, if it ensures a water ingress pressure of at least $1\times10^4$ Pa. The material of the functional layer preferably ensures a water ingress pressure of over $1\times10^5$ Pa. The water ingress pressure must be measured here by a test method wherein distilled water at 20±2° C. is applied with increasing pressure to a sample of the functional layer of 100 $cm^2$. The pressure increase of the water is 60±3 cm of water column per minute. The water ingress pressure then corresponds to the pressure at which water appears for the first time on the other side of the sample. Details of the procedure are prescribed in ISO Standard 0811 from the year 1981.

A functional layer is regarded as "water-vapor-permeable" if it has a water-vapor permeability coefficient Ret of less than 150 $m^2\times Pa\times W^{-1}$. The water-vapor permeability is tested by the Hohenstein skin model. This test method is described in DIN EN 31092 (02/94) or ISO 11092 (1993).

Whether a shoe is waterproof can be tested for example by a centrifuge arrangement of the type described in U.S. Pat. No. 5,329,807.

Suitable materials for the waterproof, water-vapor-permeable functional layer are, in particular, polyurethane, polypropylene and polyester, including polyether esters and their laminates, as described in the publications U.S. Pat. No. 4,725,418 and U.S. Pat. No. 4,493,870. Particularly preferred, however, is expanded microporous polytetrafluoroethylene (ePTFE), as described for example in the publications U.S. Pat. No. 3,953,566 and U.S. Pat. No. 4,187,390, and expanded polytetrafluoroethylene which is provided with hydrophilic impregnating agents and/or hydrophilic layers; see for example the publication U.S. Pat. No. 4,194,041. A microporous functional layer is understood to mean a functional layer of which the average pore size lies between approximately 0.2 μm and approximately 0.3 μm.

The pore size can be measured with the Coulter Porometer (trade name), which is produced by Coulter Electronics, Inc., Hialeath, Fla., USA.

If ePTFE is used as the functional layer, the reactive hot-melt adhesive can penetrate into the pores of this functional layer during the cementing operation, which leads to a mechanical anchoring of the reactive hot-melt adhesive in this functional layer. The functional layer consisting of ePTFE may be provided with a thin polyurethane layer on the side with which it comes into contact with the reactive hot-melt adhesive during the cementing operation. If PU reactive hot-melt adhesive is used in conjunction with such a functional layer, there occurs not only the mechanical bond but also a chemical bond between the PU reactive hot-melt adhesive and the PU layer on the functional layer. This leads to a particularly intimate adhesive bonding between the functional layer and the reactive hot-melt adhesive, so that particularly durable waterproofness is ensured.

Leather or textile fabrics are suitable for example as the outer material of the upper. The textile fabrics may be, for example, woven or knitted fabrics, nonwovens or felt. These textile fabrics may be produced from natural fibers, for example from cotton or viscose, from synthetic fibers, for example from polyesters, polyamides, polypropylenes or polyolefins, or from blends of at least two such materials.

When a functional layer is used, a lining material is normally arranged on the inner side. The same materials as are specified above for the outer material of the upper are suitable as lining material, which is often combined with the functional layer to form a functional-layer laminate. The functional-layer laminate may also have more than two layers, it being possible for a textile backing to be located on the side of the functional layer remote from the lining layer.

The outsole of footwear according to the invention may consist of waterproof material, such as for example rubber or plastic, for example polyurethane, or of non-waterproof, but breathable material, such as in particular leather, leather provided with rubber or plastic intarsias or rubber or plastic provided with leather intarsias. In the case of non-waterproof outsole material, the outsole can be made waterproof, while maintaining breathability, by being provided with a waterproof, water-vapor-permeable functional layer at least at points at which the sole construction has not already been made waterproof by other measures.

The insole of footwear according to the invention may consist of viscose, a nonwoven, for example polyester nonwoven, to which fusible fibers may be added, leather or adhesively bonded leather fibers. An insole is obtainable under the name Texon Brandsohle from Texon Mockmuhl GmbH of Mockmuhl, Germany. Insoles of such materials are water-permeable. An insole of such material or other material can be made waterproof by arranging a layer of waterproof material on one of its surfaces or inside it. For this purpose, for example, a film with Kappenstoff V25 from the company Rhenoflex of Ludwigshafen, Germany, may be ironed on. If the insole is to be not only waterproof but also water-vapor-permeable, it is provided with a waterproof, water-vapor-permeable functional layer, which is preferably constructed with ePTFE (expanded, microporous polytetrafluoroethylene). Suitable for this for example is a laminate which contains a waterproof, water-vapor-permeable functional layer and is obtainable under the trade name TOP DRY from W. L. Gore & Associates GmbH, Putzbrunn, Germany.

A further possibility is to adhesively attach such a laminate (TOP DRY) from beneath onto the insole and at least onto the lasted overhang of the lining, whereby the upper is made waterproof already before an outsole is cemented on.

The invention is now explained in more detail on the basis of embodiments.

DETAILED DESCRIPTION OF THE DRAWINGS

The drawings show several embodiments of footwear according to the invention in different stages of production.

FIG. 14 shows in representations A to D various embodiments of lower ends of uppers designed according to the invention;

Figure 16:
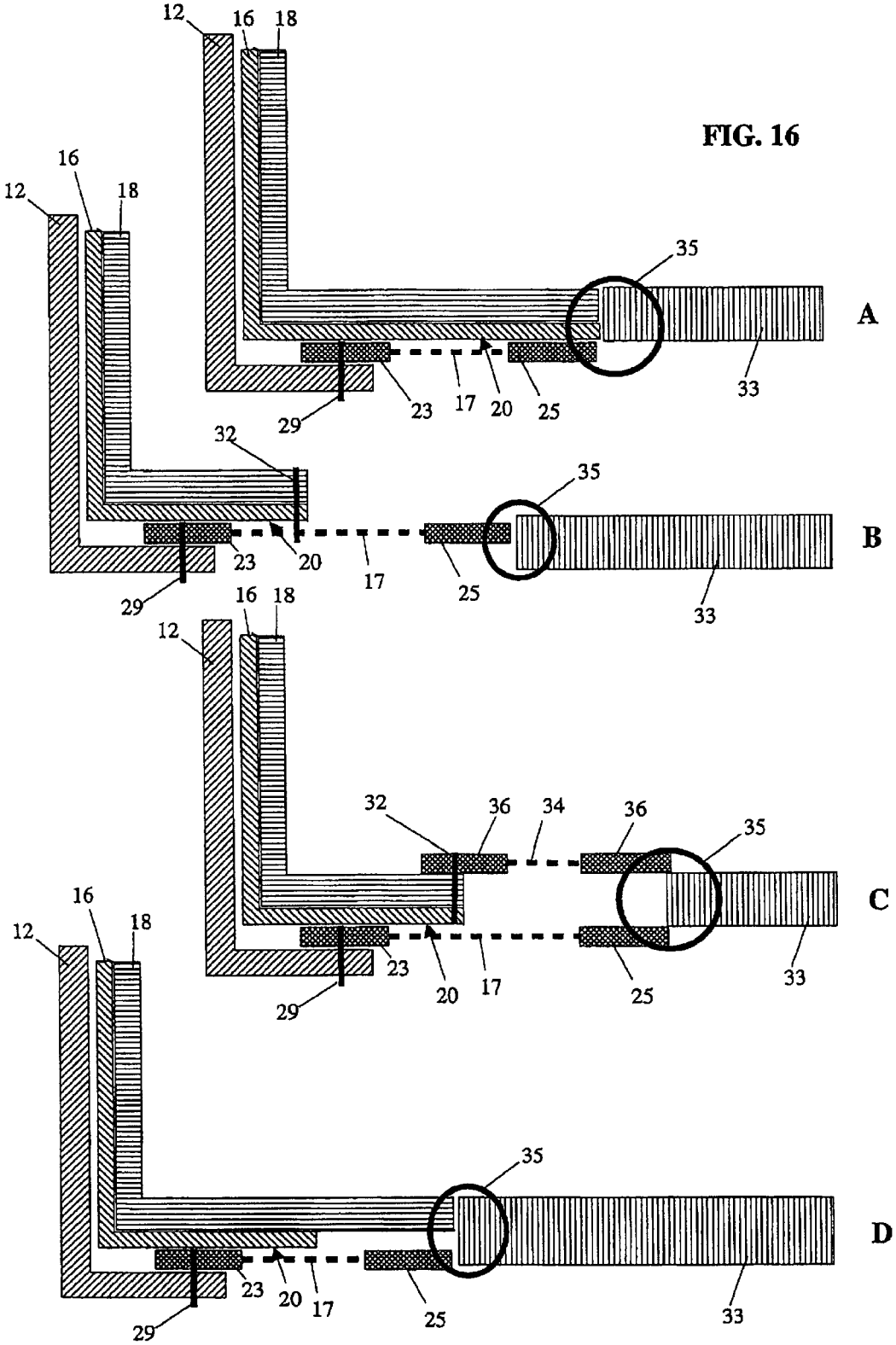

FIG. 15 shows in representations A to D the various embodiments of the lower ends of uppers according to the embodiments A to D of FIG. 14 with connecting bands extending perpendicularly in relation to an insole; and FIG. 16 shows in representations A to D the various embodiments of the lower ends of uppers according to the embodiments A to D of FIG. 14 with connecting bands extending parallel to an insole.

DETAILED DESCRIPTION OF THE INVENTION

In the text which follows, terms such as upper and lower refer to footwear that is in the normal position, that is with the outsole facing downward, even if the drawings show shoes in the inverted position.

Figure 1:
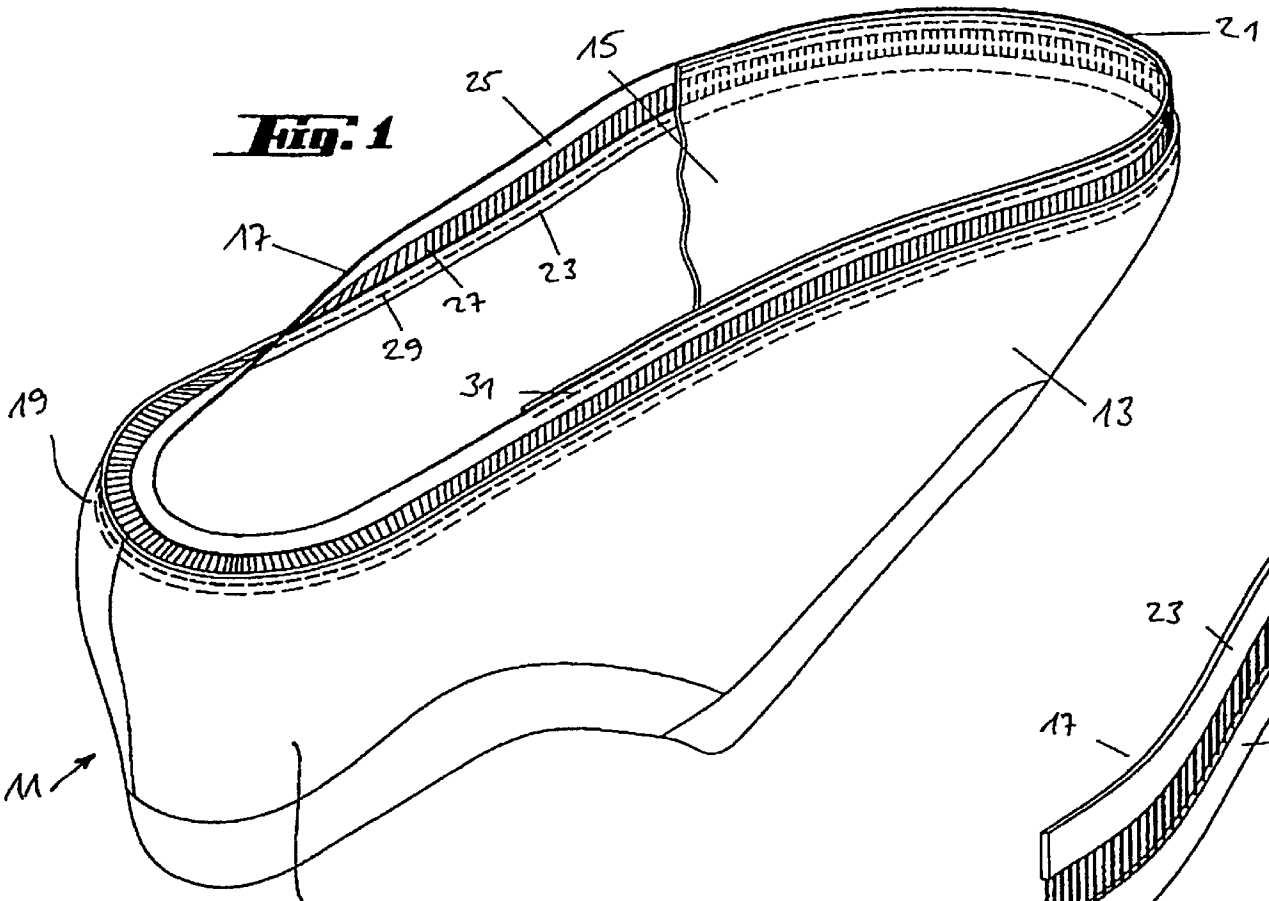
FIG. 1 shows in an oblique view a plan view of the underside of a shoe upper according to the invention of a first embodiment with a net band.

FIG. 1 shows an upper 11 with an outer material 13 of the upper, a lining material 15 of the upper and an elastic net band 17, by means of which an end region or end 19 of the outer material and an end region 21 of the lining material are joined to each other. The lining material 15 of the upper comprises a functional layer 16 (FIG. 16) and a lining layer 18, which may be individual layers or layers of a laminate. In embodiments of a first type, the functional layer 16 and the lining layer 18 have the same extents. In embodiments of a second type, the functional layer 16 is shorter than the functional layer 18 at the lower end of the upper.

Figure 2:
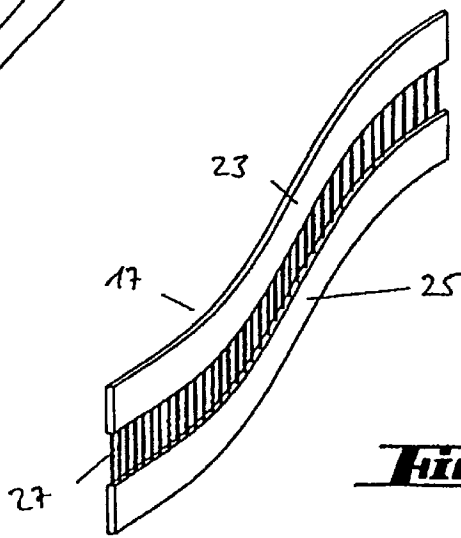
FIG. 2 shows an oblique view of an embodiment of an elastic net band used in FIG. 1.

The net band 17, represented enlarged in FIG. 2, comprises a first or upper longitudinal web 23 and a second or lower longitudinal web 25, which are joined to each other by means of transverse webs 27. As can be seen in FIG. 1, the first longitudinal web 23 is joined to the end region 19 of the outer material by means of a first seam 29 and joined to the end region 21 of the lining material by means of a second seam 31.

At least the second longitudinal web 25 consists of elastic material and is sewn to the end region 21 of the lining material while being subjected to longitudinal tensile pre-stress. The first longitudinal web 23 may, but does not have to, be elastic. The transverse webs 27 may be elastic, but are preferably non-elastic.

In one embodiment of the elastic net band 17, the two longitudinal webs 23 and 25 consist of latex rubber or some other (rubber-like) material with elastic behavior (for example Lycra, etc.) and the transverse webs 27 consist of polyamide, polyester or a similar material. The length of the transverse webs 27 and their spacing from one another are chosen such that the waterproof, water-vapor-permeable functional layer that is present in the lining material 15 of the upper can be wetted adequately by sealing material through the net band 17.

An embodiment of a currently preferred elastic net band has a width of approximately 10 mm, of which the two longitudinal webs 23 and 25 each take up approximately 3.5 mm and the clearance, that is the length of the free transverse webs 27, takes up approximately 3 mm. In this case, the transverse webs 27 have a spacing from one another of approximately 0.25 mm. In general, the choice of the spacing of the transverse webs from one another is to be based on the specific application, account having to be taken in particular of the viscosity of the sealing material for which the net band is intended to be penetrable.

In another embodiment for ski boots, the net band 17 has a width of approximately 15 mm.

In an embodiment of the net band with the above dimensions, it is a woven, elastic strip with warp or longitudinal threads of natural rubber and textured polyamide threads, a material composition of 40% natural rubber, 40% monofilament polyamide and 20% textured polyamide being preferred.

Such a net band is preferably produced by a weaving operation. In this case, warp or longitudinal threads are located only in the region of the two longitudinal webs 23 and 25, so that the transverse or weft threads lie free in the region between the two longitudinal webs 23 and 25 and can consequently form the transverse webs 27. Elastic longitudinal threads, preferably made of rubber, and non-elastic longitudinal threads, preferably made of polyamide, are used as longitudinal threads for the longitudinal webs 23 and 25, only non-elastic threads, preferably likewise made of polyamide, are used for the transverse webs. During the operation of weaving the elastic net band 17, the elastic longitudinal threads are stretched by a predetermined degree and the non-elastic longitudinal threads are arranged parallel to the stretched elastic longitudinal threads. In this state, the longitudinal threads are woven with the transverse threads. After the weaving operation, the elastic longitudinal threads contract and the net band 17 relaxes correspondingly.

In the production of this net band, different elasticity values can be produced for the two longitudinal webs 23 and 25, either by using differently extendible strips for the two longitudinal webs 23 and 25 or by stretching the two longitudinal webs 23 and 25 to different extents during the operation of weaving them with the transverse webs 27.

During the sewing of the net band 17 to the upper 11, firstly the first longitudinal web 23 is sewn to the end 19 of the outer material, to be precise while being subjected to longitudinal tensile pre-stress of the first longitudinal web 23. After securely sewing the first longitudinal web 23 to the end region 19 of the outer material, the remaining part of the net band with the second longitudinal web 25 and the transverse webs 27 flips inward, as shown in FIG. 1 in the heel region of the upper. This flipping over is a consequence of the sewing of the first longitudinal web 23 to the end region 19 of the outer material while being subjected to longitudinal tensile pre-stress. The flipping over has the effect that the net band 17 assumes a position wherein it extends substantially parallel to the outsole to be applied later. This flipping over also takes place in the toe region of the upper 11, which in most cases will then lead to the flipping over of the net band 17 over its entire length. In FIG. 1, the flipping over of the net band 17 is shown only in the heel region of the upper 11, in order to allow the joining of the lining material 15 of the upper to the net band 17 in the front foot region to be represented better.

The following figures show various embodiments of footwear according to the invention in a later stage of production than FIG. 1, to be precise each in a perspective plan view of the underside, partly in sectional view, and a part-cross-sectional view. The embodiments represented in FIGS. 3-11 and 14 to 16 differ from one another with regard to the sealing material and/or the sole construction.

Figures 3, 4:
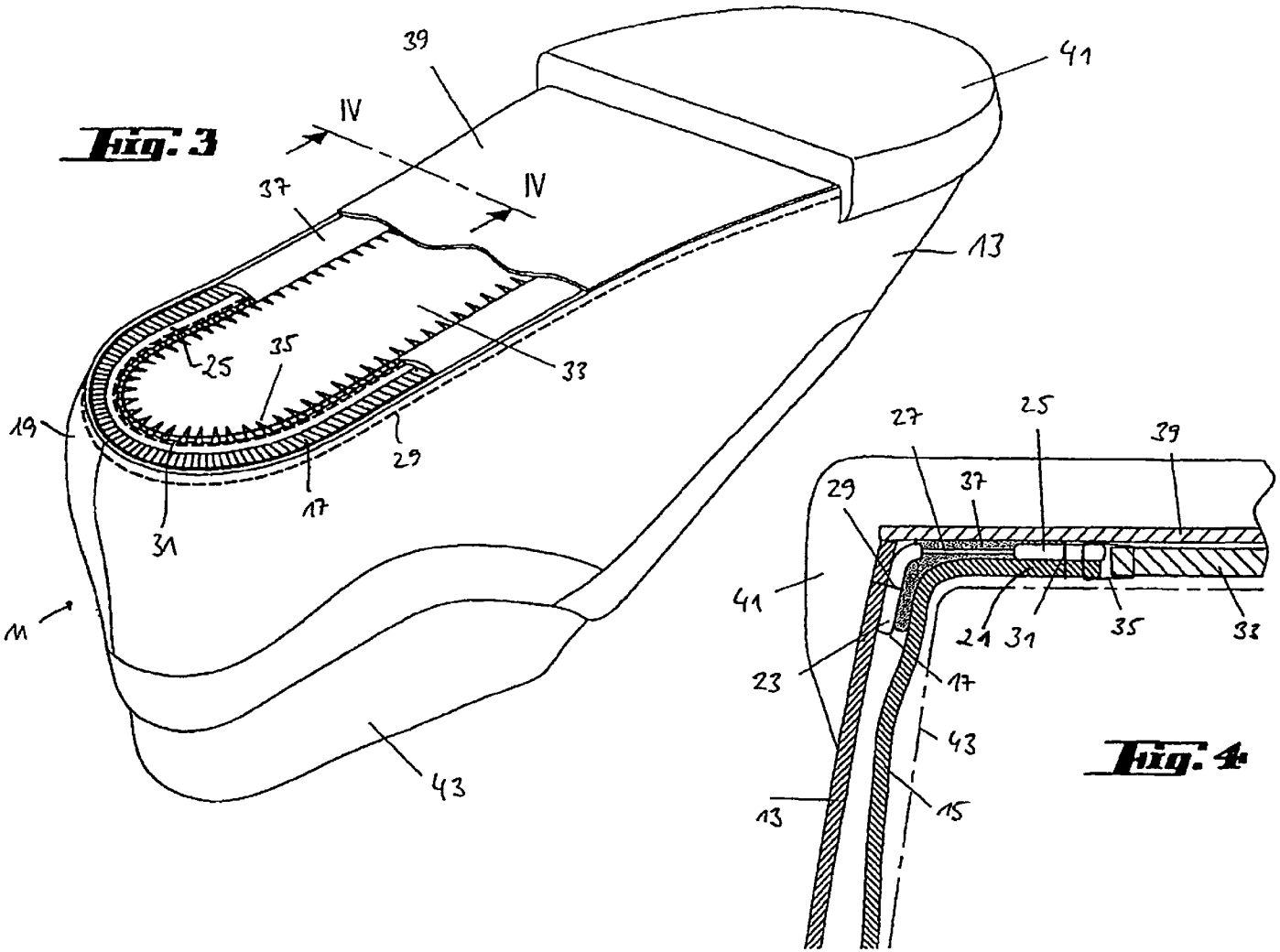
FIG. 3 shows a shoe of the style according to the invention with an insole sealed on by a Strobel seam.
FIG. 4 shows a partial sectional view of the construction according to FIG. 3.

FIGS. 3 and 4 show an embodiment of footwear according to the invention which has an insole sealed by a Strobel seam and an adhesively attached outsole.

On the basis of the upper 11 shown in FIG. 1, with a net band 17, in the embodiment shown in FIGS. 3 and 4, an insole 33 is joined to the second longitudinal web 25 of the elastic net band 17 by means of a Strobel seam 35. In this case, the net band 17 extends in the plane of the insole 33.

In a width which corresponds approximately to the width of the net band 17, there is applied to the net band 17 a sealing material in the form for example of sealing adhesive 37, which forms a closed sealing material zone which extends in the peripheral direction of the end region of the upper and wherein the sealing adhesive 37, penetrating through the net band 17, forces its way as far as the functional layer of the lining material 15 of the upper, and seals it in a waterproof manner.

For the case in which neither the insole 33 nor an intermediate sole or outsole 41 still to be applied is waterproof, the underside of the insole facing the outsole 41 is covered by a sealing sheet 39 (a gasket), which has a waterproof functional layer, which is preferably likewise water-vapor-permeable, in order to maintain breathability also in the sole region of the shoe in spite of waterproofness. The sealing sheet 39 need not—as represented in FIG. 3—extend as far as the outer edge of the net band 17. It is sufficient for it to extend by an amount which covers the insole 33 and the Strobel seam 35, the sealing sheet 39 overlapping with the sealing adhesive 37 in order to achieve secure sealing of the sole construction.

On account of its great creepability in the liquid, non-reacted state and its great and durable waterproofness in the fully reacted state, reactive hot-melt adhesive, in particular polyurethane reactive hot-melt adhesive, is preferably used as the sealing adhesive 37. On account of its great creepability in the liquid, non-reacted state, the reactive hot-melt adhesive has the ability to a particularly high degree to penetrate the elastic net band 17, to force its way as far as the functional layer of the lining material 15 of the upper and wet the latter, the reactive hot-melt adhesive getting under the transverse webs of the net band 17 and consequently making it possible for the functional layer to be wetted with the reactive hot-melt adhesive over its full surface area, and consequently has the ability to prevent water which has forced its way via the outer material 13 of the upper as far as the net band 17 from getting inside the lining material 15 of the upper and consequently inside the shoe.

Figures 5, 6:
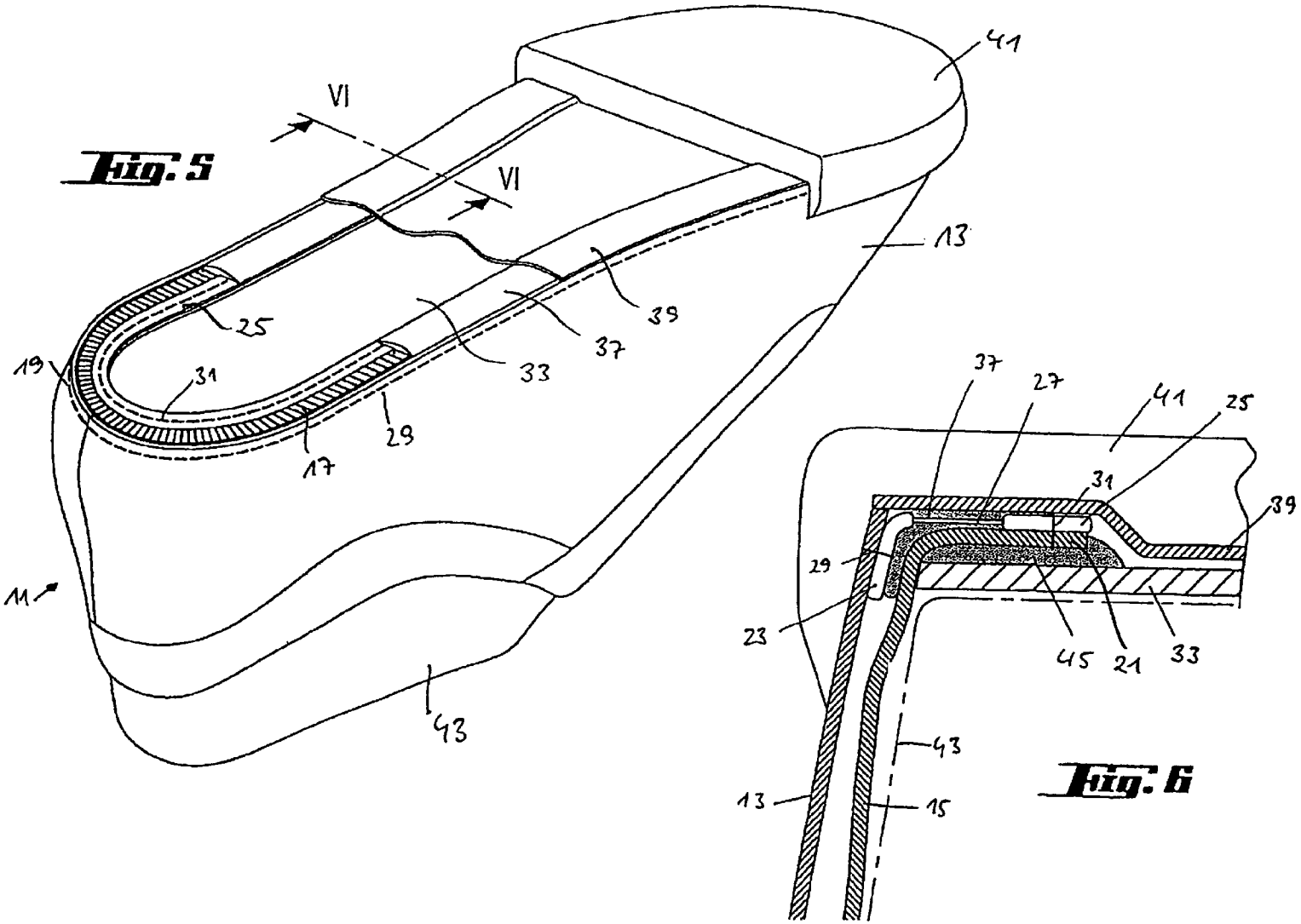
FIG. 5 shows an embodiment of a cement-lasted shoe with an insole.
FIG. 6 shows a partial sectional view of the construction according to FIG. 5.

In the embodiment shown in FIGS. 5 and 6, the turned-back part of the end region of the upper on the sole side is fastened to the insole 33 by cement-lasting. The cement-lasting takes place by means of a lasting cement 45, which can be seen in the cross-sectional view in FIG. 6.

Also in this embodiment, on the lower side of the net band 17 (facing the outsole 41) there is a sealing adhesive 37, preferably in the form of reactive hot-melt adhesive, as already explained in connection with the embodiment of FIGS. 3 and 4.

Also in this embodiment, a sealing sheet 39 or a continuous layer of reactive hot-melt adhesive applied over the surface area may be provided for the case where the outsole 41 is not waterproof.

Figures 7, 8, 9:
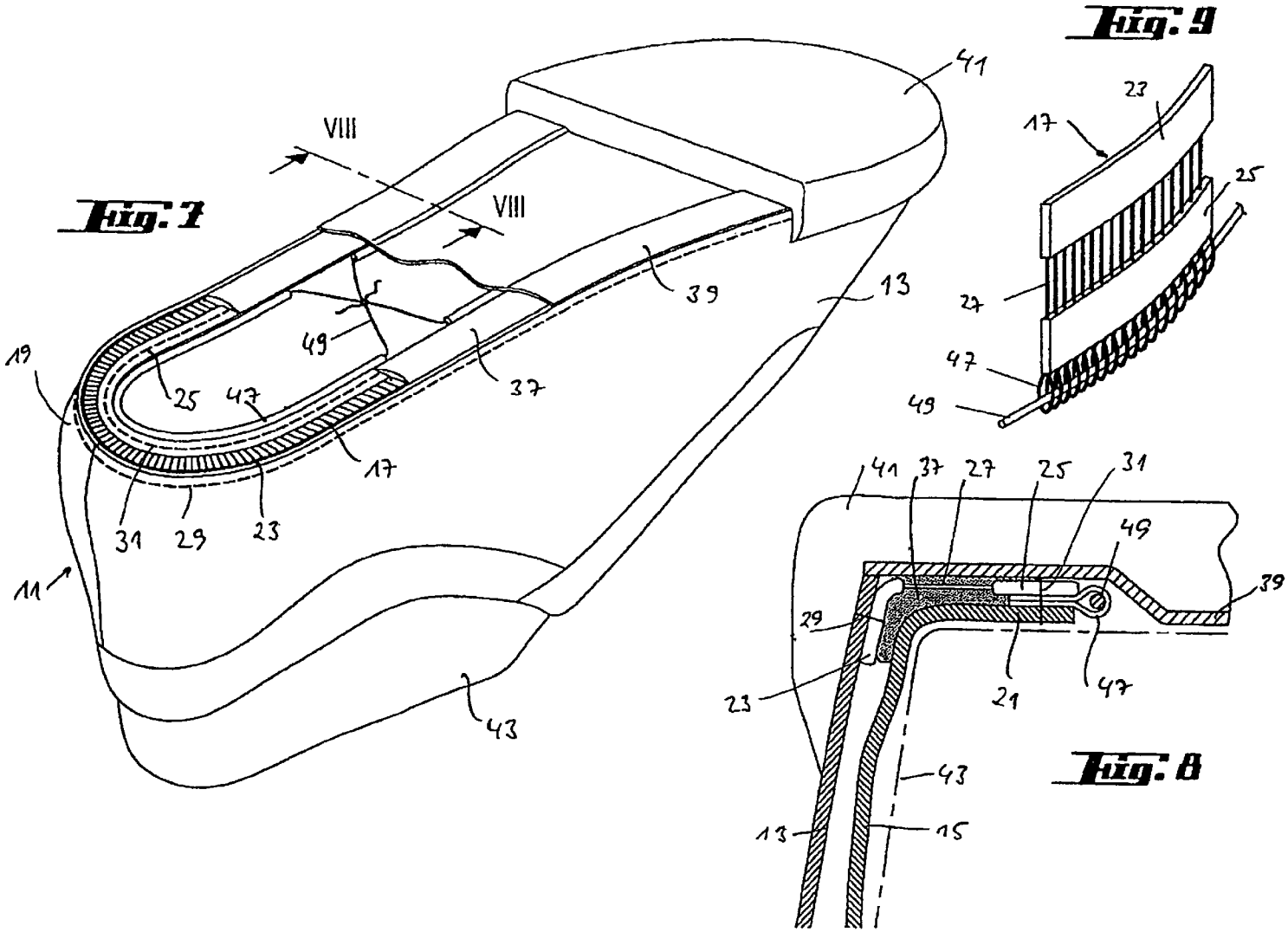
FIG. 7 shows a shoe without an insole with a lashing string (string lasting)
FIG. 8 shows a partial sectional view of the construction shown in FIG. 7.
FIG. 9 shows an embodiment of an elastic net band which can be used in FIG. 7, with an integrated string-lasting tunnel and lashing string.

FIGS. 7-9 show an embodiment of a shoe without an insole, wherein the end region of the upper on the sole side extending parallel to the outsole 41 is tensioned or lashed together by means of a lashing string 49. The lashing string 49 is guided in a string-lasting tunnel 47, which is for example attached to the second longitudinal web 25 of the elastic net band 17 in the way shown in FIG. 9. As FIG. 7 shows, the string-lasting tunnel 47 is open at two points of the periphery of the shoe which are located between the heel region and the toe region, in order to allow the lashing string 49 to be gripped, tensioned and knotted here.

Also in this embodiment, sealing adhesive 37, preferably again in the form of reactive hot-melt adhesive, is applied to the net band 17, it being possible to refer to the explanations in connection with FIG. 3 with regard to details.

While FIG. 9 shows an embodiment wherein the string-lasting tunnel 47 is attached directly to the net band 17, FIG. 8 shows an embodiment wherein an initially separate string-lasting tunnel 47 with a lashing string 49 located in it is securely sewn by means of the second seam 31 between the second longitudinal web 25 of the net band 17 and the end region 21 of the lining material.

The shoe construction corresponding to FIGS. 7 to 9 may be modified by molding onto the underside of the end region of the upper a sole made of waterproof material, which may be an intermediate sole or an outsole, by means of which sealing of the sole structure is brought about. In this case, neither a gasket nor a layer of sealing material or reactive hot-melt adhesive layer is required.

Figures 10, 11:
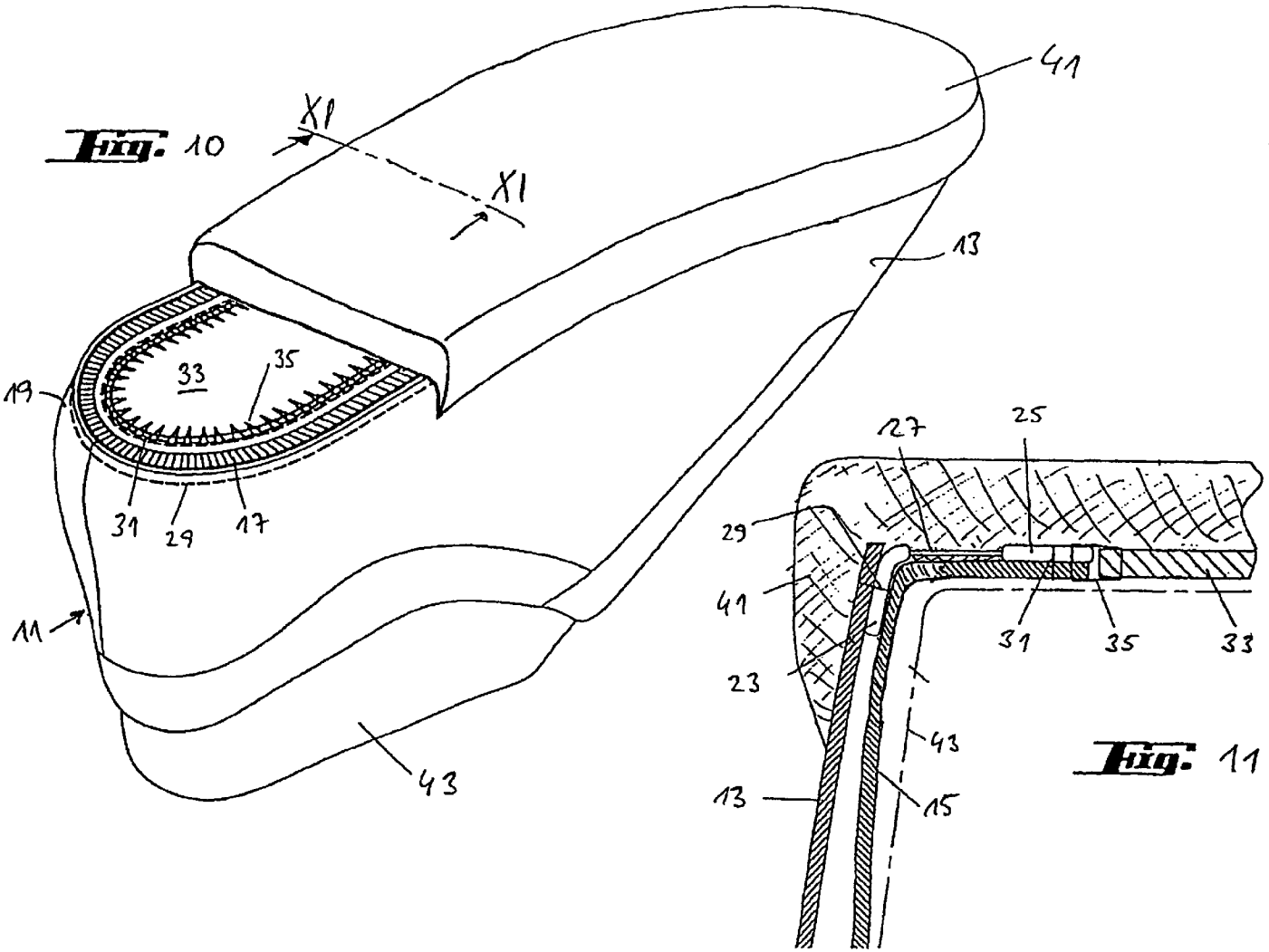
FIG. 10 shows an embodiment of a shoe according to the invention with a molded-on sole.
FIG. 11 shows a partial sectional view of this embodiment.

FIGS. 10 and 11 show an embodiment wherein the sealing material is formed by sole material of a sole, which may be for example an intermediate sole or the outsole 41. In this embodiment, all the production steps up to the fastening of the insole to the net band 17 by means of a Strobel seam 35 proceed in the way shown in FIGS. 3 and 4 and explained there or by means of a lashing string as explained in connection with FIGS. 7 to 9. As a departure from the embodiment in FIGS. 3 and 4, in the embodiment according to FIGS. 10 and 11 no sealing adhesive 37 and no gasket is applied. In the embodiment according to FIGS. 10 and 11, the shoe has a molded-on sole 41. The sole material, which is liquid when the sole 41 is molded on, penetrates through the net band 17, wets the functional layer of the lining material 15 of the upper in the region of the net band 17 and brings about sealing of the functional layer in this region. The sealing function which in the embodiments of FIGS. 3 and 7 is undertaken by separately applied sealing adhesive 37 is performed in the embodiment according to FIG. 10 by the sole adhesive.

A sealing sheet 39, as shown in the previous embodiments, is not required in the embodiment according to FIG. 10, because the molded-on outsole 41 seals the entire region of the sole structure.

While the embodiment according to FIG. 10 is suitable only for shoes with a molded-on sole, the embodiments according to FIGS. 5 and 7 can be used for soles which are not molded on, that is to say for soles which are adhesively attached, which may be plastic soles and consequently waterproof soles, so that the sealing sheet 39 is not required, or water-permeable soles, for example made of leather, wherein case the sealing sheet 39 is recommendable to make the sole construction waterproof, the sealing sheet preferably being not only waterproof but also water-vapor-permeable.

Figure 12:
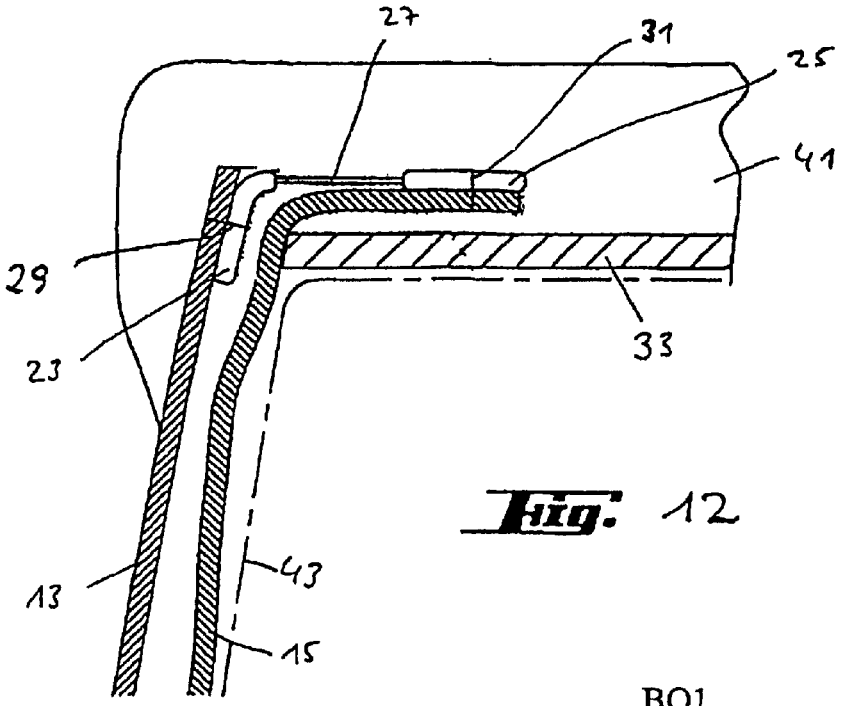
FIG. 12 shows a partial sectional view of a construction with sealing by means of a molded-on sole.

FIG. 12 shows a partial sectional view of a cement-lasted shoe construction with a molded-on sole 41, which may be an intermediate sole or an outsole. During the molding on of the sole 41, liquid sole material penetrates through the net band 17, forces its way as far as the functional layer of the lining material 15 and seals the functional layer. A gasket or a layer of sealing material is therefore not required. Otherwise, the construction in FIG. 12 coincides with the construction shown in FIG. 6.

Figure 13:
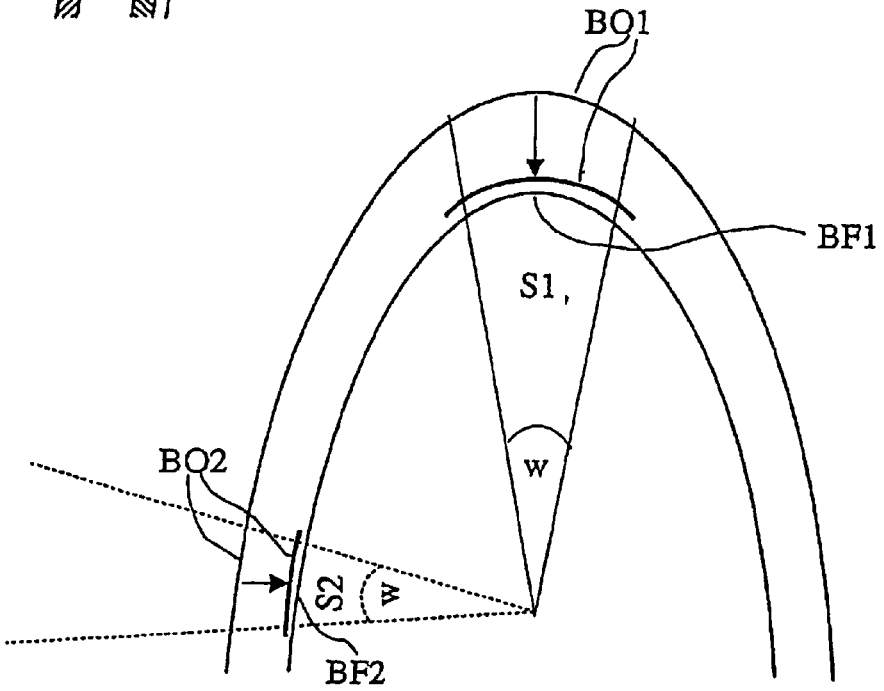
FIG. 13 shows a diagram to explain some of the terms used in the present document.

On the basis of FIG. 13, the terms used above, arc sector, arc lengths and unitary sector angle, are now also explained. FIG. 13 shows two elliptical arcs, to be precise an outer elliptical arc and an inner elliptical arc, which are intended respectively to represent the longitudinal side of the connecting band that is joined to the end region of the outer material and the longitudinal side of the connecting band that is joined to the end region of the lining material. At a point of strong elliptical curvature and at a point of weak elliptical curvature, an arc sector S1 and an arc sector S2 are respectively formed by means of the two lines of an angle. Both arc sectors S1 and S2 have the same angle w, which is referred to here as the unitary sector angle. The lines of the angle of the arc sector S1 bound an outer arc length BO1 of the outer ellipse and an inner arc length BF1 of the inner ellipse. In this case, BO represents the arc length of the outer material and BF represents the arc length of the lining material. The lines of the angle of the arc sector S2 bound an outer arc length BO2 of the outer ellipse and an inner arc length BF2 of the inner ellipse. The arc lengths BO1 and BO2 are duplicated and offset as thick lines close to the arc length BF1 and BF2, respectively, in order to make clear the differences in length between BO1 and BF1 on the one hand and between BO2 and BF2 on the other hand. It can be seen on the one hand that there are differences in length between the outer arc lengths and the inner arc lengths of the respective sector and on the other hand that this difference in length is much greater at the point of stronger elliptical curvature than at the point of weaker elliptical curvature.

When using a conventional net band, which cannot compensate for these differences in length, folding is caused. When using a connecting band according to the invention, by means of which such differences in length can be compensated, folding is avoided. The fact that the differences between outer and inner arc lengths are different at points with different degrees of elliptical curvature shows on the one hand that the conical connecting band conventionally used cannot avoid folding and shows on the other hand that an elastic net band with which an arc length compensation can be produced unproblematically and simply, even in the case of differences of differing magnitude between the outer arc length and the inner arc length, is to be particularly preferred.

In the case of use of an elastic connecting band, it should have a minimum elasticity, that is to say minimum extendibility before reaching plastic deformation, in order to achieve the adaptation to the different arc lengths at the peripheral edges of the end region of the outer material and the end region of the lining material, and consequently at the two longitudinal sides of the elastic connecting band, even at points of strong curvature of the periphery of the end region of the upper. The elastic extendibility should be so great that the elastic connecting band can be sewn onto the outer material of the upper with adequate longitudinal tensile pre-stress to prevent folding in the connecting band and in the material sewn to it on the other side than the end of the outer material. The elastic restoring force of the elastic connecting band should be adequate to provide the connecting band with the pre-stressing force required for arc length compensation.

General values or limits for the elasticity, the longitudinal tensile pre-stress and the elastic restoring force cannot be given, since they depend on the specific form of shoe and the associated maximum curvatures of the periphery of the end region of the upper. However, it should be an easy matter for a person skilled in the relevant art to determine and select the elasticity parameters of the connecting band that are suitable for a specific shoe.

Suitable in particular as elastic material for the elastic longitudinal web or the elastic longitudinal webs of the elastic connecting band are unvulcanized rubber, vulcanized rubber, elastic plastics, such as synthetic rubber, PVC, silicone, PU for example, and textile materials wherein rubber filaments and/or filaments of such materials are incorporated.

The elastic connecting band has an extendibility of at least approximately 20%. The connecting band preferably has an extendibility of at least approximately 30%, with particular preference of at least approximately 40% and most particular preference of at least approximately 50%. These extendibility values have in this case an elastic elongation component of at least 40%. The elastic elongation component is preferably 100%. In particular, at least the longitudinal web of the elastic connecting band that is not to be joined to the end of the outer material, for example to the end region of the lining material, has an elastic extendibility that is as high as possible, in order to achieve the desired freedom from folds at the points of the lower periphery of the end region of the upper having a strong curvature.

In a practical example of an elastic net band used for the invention, with the dimensions already mentioned (net band width 10 mm, longitudinal web widths each approximately 3.5 mm, transverse web length approximately 3 mm, transverse web spacings approximately 0.25 mm) and the already mentioned materials (longitudinal webs: woven, elastic strip with warp or longitudinal threads made of natural rubber and textured polyamide threads with a material composition of 40% natural rubber, 40% monofilament polyamide and 20% textured polyamide; transverse webs: polyester), the following rounded average values have been obtained from the measurements of several samples:

- elongation of 66% while being subjected to a stretching force of 50 N
- elongation of 85% while being subjected to a stretching force of 100 N
- elongation of 100% while being subjected to a stretching force of 150 N
- elongation at break of 124% while being subjected to a stretching force of 206 N In comparison with this, a net band as used in conventional footwear and having a width of likewise 10 mm has the following values, likewise averaged from three samples:

- elongation of 4% while being subjected to a stretching force of 50 N
- elongation of 10% while being subjected to a stretching force of 100 N
- elongation of 15% while being subjected to a stretching force of 150 N
- elongation at break of 30% while being subjected to a stretching force of 360 N Values for the elasticity and restoring force are determined by tensile test measurements on the basis of European Standard EN ISO 13934-1 of April 1999 using an Instron test device (where Instron is the name of a manufacturer).

With regard to elongation and elasticity, the following definitions devised for the textile sector have been adopted for the present application.

Elongation:

Tensile loading of a material causes an elongation—with respect to its original length. A distinction is drawn between elongation at break, elastic elongation and permanent elongation. In the case of elongation at break, the extending at the time of breakage is determined. While being subjected to loading below the breaking limit, an elongation that is reversed when the material is relieved of loading takes place (elastic elongation), by contrast with irreversible permanent elongation, which leads to a change in shape of the material.

Elasticity:

Ability of a material to reverse the change in shape caused by the action of a force (bending, pressure, tension, etc.) when the effect of the force subsides.

On the basis of FIGS. 14 to 16, various embodiments of lower ends of uppers designed according to the invention and how they are joined together with intermediate soles, for example insoles, in different configurations are also considered in a very schematized form of representation.

Four different types of design of lower ends of uppers are shown in the representations A to D of FIG. 14.

Of these, representation A shows the type of design already shown in embodiments of FIGS. 1 to 12 and already explained on the basis of these figures, wherein the lower end 13 of the outer material is extended downward by means of the connecting band 17, the lower end 13 of the outer material is joined to the first or upper longitudinal web 23 of the connecting band 17 by means of a first or upper seam 29 and the lower end of the lining material 15 of the upper reaches down as far as the second or lower longitudinal web 25 and is joined to the latter by means of the second or lower seam 31. In this case, the lining material 15 of the upper has a functional layer 16 and a lining layer 18. The functional layer has in the region adjacent to the connecting band 17 a functional layer zone 20, wherein the functional layer 16 can be sealed in a waterproof manner by means of the connecting band 17 itself, if it consists of activatable sealing material, or through the connecting band 17, if it consists of material through which liquid sealing material can flow.

The representation B of FIG. 14 shows a type of design wherein the lining material 15 of the upper, having the functional layer 16 and the lining layer 18, ends above the lower longitudinal web 31 of the connecting band 17, to be precise in a region of the connecting band 17 located between the two longitudinal webs 23 and 25. In this case, the lining material 15 of the upper is fastened by means of a seam 32 in a central region of the connecting band 17 located between the two longitudinal webs 23 and 25. In this design, liquid sealing material which flows through the connecting band not only flows to the functional layer zone 20 but in the region underneath the edge of the functional layer can also force its way inside footwear provided with a construction of the upper of this type.

The representation C of FIG. 14 shows a type of design wherein the lining material 15 of the upper, having the functional layer 16 and the lining layer 18, likewise ends above the lower longitudinal web 31 of the connecting band 17, but the lower end of the lining material 15 of the upper is extended by means of a second connecting band 34 down to the height of the lower longitudinal web 25 of the first connecting band 17. In this case, a upper longitudinal web 36 of the second connecting band 34 is fastened to the lower end of the lining material 15 of the upper by means of the seam 32 and a lower longitudinal web 38 of the second connecting band 34 is fastened to the lower longitudinal web 25 of the first connecting band 17 by means of the seam 31. The lower longitudinal web 38 of the second connecting band 34 could, however, also be fastened to another element of the construction of the upper or of the shoe by a separate seam.

The representation D of FIG. 14 shows a type of design wherein, although the lining layer 18 reaches down as far as the lower longitudinal web 25 of the first connecting band 17 and is joined to the lower longitudinal web 25 of the first connecting band 17 by means of the lower seam 31, the functional layer 16 stops above the lower end of the lining layer 18. If a material through which liquid sealing material can flow is used for the lining layer 18, it is possible in the case of this type of design, in just the same way as in the case of the type of design B, for liquid sealing material not only to flow to the functional layer zone 20 but also to force its way to the inner region of the footwear provided with a construction of the upper of this type. The type of design D can also be modified by extending its lower end of the functional layer by means of a second connecting band in the same way as in the case of the type of design C. In the case of the type of design D, however, the lower end of the lining layer 18 could also be fastened to another element of the construction of the upper or of the shoe by a separate seam.

FIG. 15 shows in representations A to D the various designs A to D of the upper of FIG. 14 each with an intermediate sole, for example an insole 33, to be precise with connecting bands 17, and if appropriate 34, extending perpendicularly in relation to the insole 33. In this case, the join to the insole 33 is produced in the exemplary embodiments represented by means of a Strobel seam 35.

FIG. 16 shows in representations A to D the various designs A to D of the upper of FIG. 14 each with an intermediate sole, for example an insole 33, to be precise with connecting bands 17, and if appropriate 34, extending parallel to the insole 33. In this case, the join to the insole 33 is produced in the exemplary embodiments represented by means of a Strobel seam 35, but could also be produced by a cement-lasting connection between the lower end of the construction of the upper and the insole 33. As a departure from the designs A to D of FIG. 16, the lower end of the respective construction of the upper may also be joined to a string-lasting channel instead of to an insole or other type of intermediate sole, for example in the case of footwear which does not have an intermediate sole or an insole at all or in part of its length.

The invention claimed is:

1. A shoe upper comprising:

a lower end of the upper, an outer material with a lower end of the outer material, a waterproof functional layer, which has a lower end region of the functional layer with a functional layer zone not covered by outer material, wherein the functional layer comprises a lower edge;

a connecting, band, which extends in the direction of the periphery of the upper, and which has a connecting band upper longitudinal side, joined to the lower end of the outer material, and a connecting band lower longitudinal side, and which at least partially overlaps the functional layer zone and which consists of liquefiable sealing material or of material through which liquid sealing material can flow, wherein at points of curvature of the lower end of the upper the connecting band extends in an arc corresponding to the local radius of curvature, with the two longitudinal sides of the connecting band having different degrees of curvature, in such away that, for an arc sector lying in the respective curvature, with a predetermined unitary sector angle, the arc lengths of the two longitudinal connecting band sides belonging to this arc sector differ from each other the more, the greater the curvature of the respective arc sector is, wherein the connecting band comprises a lower longitudinal edge, further wherein the lower edge of the functional layer ends above the height of the lower longitudinal edge of the connecting band.

2. The shoe upper as claimed in claim 1, wherein the lower longitudinal side of the connecting band is joined to the functional layer.

3. The shoe upper as claimed in claim 1, wherein a region of the connecting band located between the two longitudinal sides of the connecting band is joined to the functional layer.

4. The shoe upper as claimed in claim 1, with a lining arranged on the inner side of the functional layer.

5. The shoe upper as claimed in claim 4, wherein the functional layer and the lining are equally long in the lower end region of the upper.

6. The shoe upper as claimed in claim 5, wherein the functional layer and the lining end above the lower longitudinal side of the connecting band.

7. The shoe upper as claimed in claim 6, wherein the functional layer and the lining end above the lower longitudinal side of the connecting band and are extended by a second connecting band in the direction of the lower end of the upper.

8. The shoe upper as claimed in claim 7, wherein the second connecting band consists of liquefiable sealing material or of material through which liquid sealing, material can flow and wherein at points of curvature of the lower end of the upper the second connecting band extends in an arc corresponding to the local radius of curvature, with the two longitudinal sides of the connecting band having different degrees of curvature, in such a way that, for an arc sector lying in the respective curvature, with a predetermined unitary sector angle, the arc lengths of the two longitudinal connecting band sides belonging to this arc sector differ from each other the more, the greater the curvature of the respective arc, sector is.

9. The shoe upper as claimed in claim 7, wherein a lower longitudinal side of the second connecting band is joined to the lower longitudinal side Of the first connecting band.

10. The shoe upper as claimed in claim 4, wherein the lower end of the lining is longer than the lower end of the functional layer.

11. The shoe upper as claimed in claim 10, wherein the lower end of the lining is joined to the lower longitudinal side of the connecting band.

12. The shoe upper as claimed in claim 10, wherein the functional layer and the lining are parts of a laminate and the lower end of the functional layer is shortened with respect to the lower end of the lining by paring.

13. The shoe upper as claimed in claim 1, with an insole joined to the lower end of the upper.

14. The shoe upper as claimed in claim 13, the insole being joined to the lower longitudinal side of the connecting band.

15. The shoe upper as claimed in claim 13, the insole being joined to the lower longitudinal side of both the first and a second connecting band.

16. The shoe upper as claimed in claim 13, the insole being joined to the lower end of a lining.

17. The shoe upper as claimed in claim 1, wherein, at points of the lower end of the upper with convex curvature, the arc length of the upper longitudinal side of the first connecting band is longer than the arc length of the lower longitudinal side of said connecting band.

18. The shoe upper as claimed in claim 1, wherein, at points of the lower end of the upper with concave curvature, the arc length of the lower longitudinal side of the first connecting band is longer than the arc length of the upper longitudinal side of said connecting band.

19. The shoe upper as claimed in claim 1, wherein, at points of the lower end of the upper with convex curvature, the arc length of the upper longitudinal side of a second connecting band is longer than the arc length of the lower longitudinal side of said connecting band.

20. The shoe upper as claimed in claim 1, wherein, at points of the lower end of the upper with concave curvature, the arc length of the lower longitudinal side of a second connecting band is longer than the upper longitudinal side of said connecting band.

21. The shoe upper as claimed in claim 1, wherein the functional layer zone not covered by outer material is formed by an overhang of the end region of the functional layer with respect to the end of the outer material.

22. The shoe upper as claimed in claim 1, with a substantially rigid connecting band, wherein the differences in arc length, dependent on the respective arc curvature, of the two longitudinal sides of the connecting band are incorporated correspondingly into the band at the production stage.

23. The shoe upper as claimed in claim 22, with a punched connecting band.

24. The shoe upper as claimed in claim 22, with an injection-molded connecting band.

25. The shoe upper as claimed in claim 1, with an elastically extendible connecting band, which is joined on at least one of its longitudinal sides to, the associated material while being subjected to longitudinal tensile pre-stress.

26. The shoe upper as claimed in claim 1, with a deformable connecting band, which is joined on at least one of its longitudinal sides to the associated material while being subjected to, longitudinal tensile pre-stress leading to plastic deformation.

27. The shoe upper as claimed in claim 1, wherein the connecting band is joined, on its lower longitudinal side to the associated material while being subjected to longitudinal tensile pre-stress.

28. The shoe upper as claimed in claim 1, wherein the upper longitudinal side of the connecting band is sewn to the end of the outer material.

29. The shoe upper as claimed in claim 1, wherein the lower longitudinal side of the connecting band is sewn to the functional layer.

30. The shoe upper as claimed in claim 1, wherein the connecting band is non-porous.

31. The shoe upper as claimed in claim 30, wherein the connecting band is constructed with a sealing material which can be activated by means of activation energy, selected from the forms of energy thermal energy, high frequency energy, infrared energy and UV energy, into a temporarily liquid state.

32. The shoe upper as claimed in claim 30 for footwear with a molded-on sole, wherein the connecting band consists of a material which can be melted by hot-liquid sole material during the molding-on of the sole.

33. The shoe upper as claimed in claim 30, wherein the connecting band is formed by a polyurethane strip.

34. The shot upper as claimed in claim 1, wherein the connecting band is porous in such a way that it can be penetrated by liquid sealing material.

35. The shoe upper as claimed in claim 34, wherein the connecting band is formed by a net band, which has an upper longitudinal web on its upper longitudinal side and a lower longitudinal web on its lower longitudinal side, which webs are joined to each other by means of transverse webs.

36. The shoe upper as claimed in claim 35, wherein at least the lower longitudinal web is constructed using elastically compliant material.

37. The shoe upper as claimed in claim 35, wherein the transverse webs are constructed using non-elastic material.

38. The shoe upper as claimed in claim 35, wherein the net band is woven, and wherein longitudinal threads, serving as warp, threads, of which at least some are elastic, at least with regard to the upper longitudinal web, are present only in the regions of the longitudinal webs, and the transverse webs are formed by weft threads.

39. The shoe upper as claimed in claim 1, wherein the longitudinal side of the connecting band is joined to a string-lasting tunnel, wherein a lashing string is arranged, which is longitudinally movable in relation to the string-lasting tunnel and whose lashing together tautens the lower end region of the upper in the inward direction in such a way that the lower end region of the upper with the connecting band extend in the direction of the extent of an outsole still to be applied.

40. The shoe upper as claimed in claim 39, with a lining arranged on the inner side of the functional layer, wherein the lower end of the functional layer or the tower end of the lining or the lower longitudinal side of a second connecting band is joined to the string-lasting tunnel, wherein the lashing string is arranged, which is longitudinally movable in relation to the string-lasting tunnel.

41. The shoe upper as claimed in claim 1, wherein the functional layer is water-vapor-permeable.

42. The shoe upper as claimed in claim 41, wherein the functional layer has a layer of microporous PTFE.

43. The shoe upper as claimed in claim 25, wherein the connecting band has an extendibility of at least 20%.

44. Footwear with a shoe upper as claimed in claim 1.

45. The footwear as claimed in claim 44, further comprising a sealing material, which seals the functional layer zone in a waterproof manner in a sealing material zone that extends in the peripheral direction of the lower end of the upper.

46. The footwear as claimed in claim 45, further comprising a molded-on sole, whose sealing material is formed by sole material which is liquid during the molding-on of the sole and, which by penetrating through a porous first connecting band, seals in a waterproof manner at least part of the width of the functional layer zone.

47. The footwear as claimed in claim 45, wherein the sealing material is formed by adhesive which leads to waterproofness in the cured state and which, by penetrating through a porous first connecting band, seals in a waterproof manner at least part of the width of the functional layer zone.

48. The footwear as claimed in claim 47, wherein the sealing material comprises reactive hot-melt adhesive, which leads to waterproofness in the fully reacted state.

49. The footwear as claimed in claim 44, further comprising an insole, the lower end of the upper and the functional layer zone extend in the direction of the extent of the insole.

50. The footwear as claimed in claim 49, wherein the insole is joined to the functional layer and the lower longitudinal side of the connecting band by means of a Strobel seam.

51. The footwear as claimed in claim 49, wherein the lower end of the upper is lasted by means of lasting cement onto a lower peripheral edge of the insole.

52. The footwear as claimed in claim 44, further comprising a sheet-like waterproof sealing, layer, which is applied to the underside of the lower end of the upper such that it extends parallel to a still to be applied sole in such a way that a lower opening of the upper is sealed as far as a sealing material zone.

53. The footwear as claimed in claim 52, wherein the sealing layer is formed by a sealing sheet, which is cemented onto the underside of an insole.

54. The footwear as claimed in claim 53, wherein the sealing sheet has an additional waterproof functional layer.

* * * * *